United States Patent [19]

Mangan

[11] Patent Number: 4,646,483

[45] Date of Patent: Mar. 3, 1987

[54] VANES FOR ABRASIVE BLASTING WHEELS

[75] Inventor: Jerry M. Mangan, Hagerstown, Md.

[73] Assignee: Pangborn Corporation, Hagerstown, Md.

[21] Appl. No.: 785,176

[22] Filed: Oct. 7, 1985

[51] Int. Cl.[4] ..... B24C 5/06

[52] U.S. Cl. ..... 51/434; 51/435; 416/197 R; 241/275

[58] Field of Search ..... 51/432, 433, 434, 435; 241/275; 416/197 R, 243

[56] References Cited

U.S. PATENT DOCUMENTS

| | | | |
|---|---|---|---|
| 1,789,874 | 1/1931 | Lilly | 51/435 X |
| 2,306,847 | 12/1942 | Turnbull | 51/434 |
| 2,493,215 | 1/1950 | Barnes | 51/435 X |
| 3,287,858 | 11/1966 | Moore et al. | 51/435 X |
| 3,921,337 | 11/1975 | Maeda | 51/432 |
| 4,174,814 | 11/1979 | Warren et al. | 51/435 X |
| 4,521,996 | 6/1985 | Grund et al. | 51/434 |

*Primary Examiner*—Robert P. Olszewski

*Attorney, Agent, or Firm*—Charles E. Brown

[57] ABSTRACT

A blasting wheel is provided with vanes having a relatively concave face to project abrasive particles in a narrow pattern.

12 Claims, 13 Drawing Figures

FIG. 12
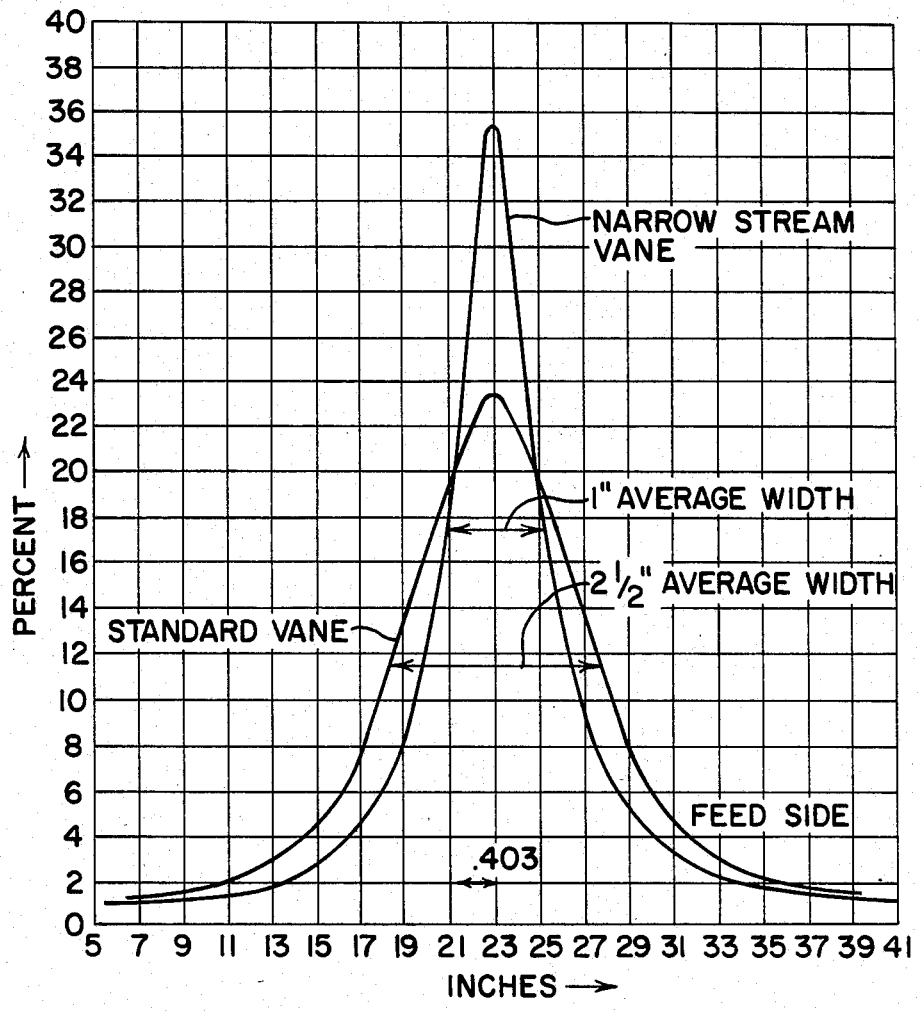
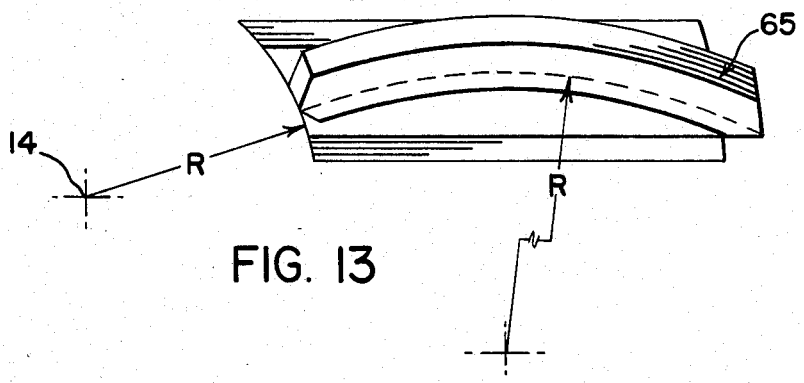
FIG. 13

VANES FOR ABRASIVE BLASTING WHEELS

BACKGROUND OF THE INVENTION

Present methods of blast cleaning utilize a centrifugal throwing wheel for projecting abrasive particles. The wheel assembly is comprised of a runnerhead with blades or vanes attached and an impeller cage for feeding abrasive particles to the root or heel of the vanes which propel and discharge the particles centrifugally in any desired direction.

The present invention relates to an improved vane configuration which projects the abrasive particles in a narrow pattern, thereby concentrating the blast effect in a manner not available with blast wheels currently on the market. A narrow blast pattern is far more effective on rod and wire product than a relatively wider pattern and also permits selective blast action on larger work pieces where needed, such as in gear peening and for engine block openings.

In the past, efforts have been made to achieve a narrow blast pattern, but these attempts have not been successful. One proposed solution was to provide a channel on the face of the vanes which, while relatively wide at the root of the vanes, narrowed as it approached the tip of the vanes from which the abrasive particles are projected. The tapering side walls of the channel, which forced the abrasive particles toward the center (a narrowed path), of course caused accelerated abrasive wear on the side walls and too frequent replacement of the vanes. Other undesirable effects were noted and will be discussed hereinafter. U.S. Pat. No. 3,287,858, issued Nov. 29, 1966 to R. W. Moore et al shows a vane intended to project a narrow pattern of abrasive particles in accordance with the prior art.

SUMMARY OF THE INVENTION

An abrasive blasting wheel assembly is provided comprising a rotatable blast wheel with radially extending vanes thereon which project a relatively narrow pattern of abrasive particles onto a work piece. The vanes comprise a relatively wide root end or region to receive abrasive particles and a tip end or region from which the abrasive particles are discharged. The face of the vanes present a channel configuration having a generally concave surface. The abrasive particles move along the channel surface from the root region to the tip region and the concavity of the surface urges particles originally situated along the edges of the channel toward the center, thereby assuring a narrow field for the projection of the abrasive particles.

The generally concave channel may be provided by a flat central bottom surface flanked by a pair of canted surfaces sloping upward to the channel edge. The upward slope of the canted surfaces is at least 5° and, preferably, will lie in the range from about 5 degrees up to about 15 degrees.

The channel may be uniform in width or it may have a tapered configuration.

The vane may be provided with greater thickness at the tip thereof than at the root, and the thickness may increase uniformly from root region to tip region.

DESCRIPTION OF THE DRAWINGS

FIG. 12 is a graph comparing the blast pattern of a blasting wheel having conventional vanes with that of a blasting wheel provided with vanes in accordance with the present invention;

FIG. 13 is a detached plan view of a rotatable blast wheel showing a curved vane made in accordance with the invention.

DETAILED DESCRIPTION OF THE INVENTION

Figure 1:
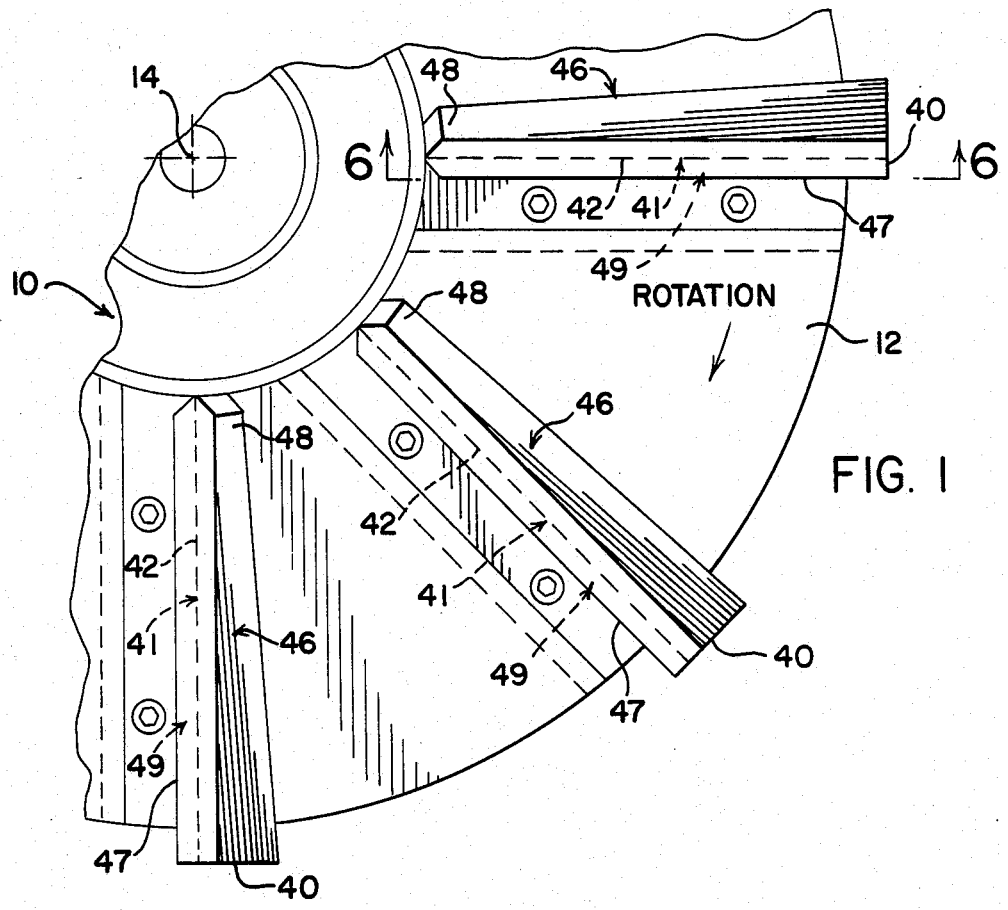
FIG. 1 is a fragmentary plan view of a portion of the rotatable blast wheel having vanes in accordance wth the present invention.

As illustrated in the drawings and in particular FIG. 1, a blasting wheel assembly, generally indicated by the numeral 10 includes a blast wheel 12 mounted for rotation about an axis 14 and having a plurality of vanes 46 extending generally perpendicular to one face of the wheel. The vanes 46 extend generally radially from the axis of rotation 14 and have a root end 48 spaced from the axis of rotation 14 and a tip end 40 spaced a greater distance from the axis of rotation 14. A conventional impeller cage (not shown) is disposed on the wheel 12 between the root ends of the vanes for feeding abrasive particles to the vanes through at least one feed slot in the cage.

Figure 2:
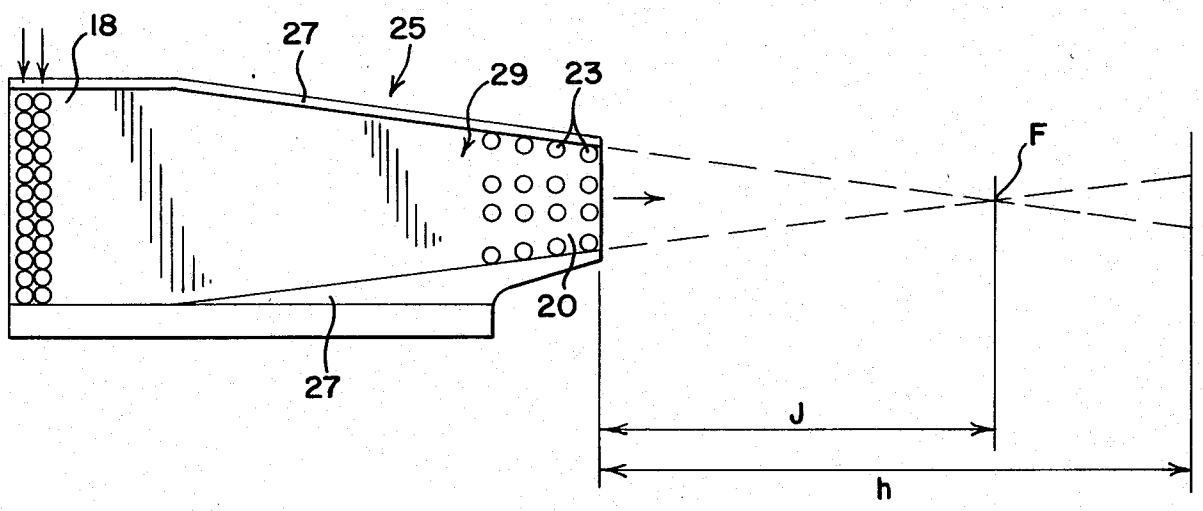
FIG. 2 (PRIOR ART)
FIG. 2 is a view of a prior art vane looking at its face.

An initial discussion in some detail, of a prior art vane configuration intended to achieve a narrow blast pattern, will be set forth at this point as an aid in understanding the invention. In FIG. 2, the prior art vane 25 has upwardly extending sides 27 which serve to form an open channel 29 on the face through which the abrasive passes. The sides 27 taper inwardly, gradually narrowing the channel 29 as it approaches the tip end. This arrangement produces a tapered path for the abrasive particles 23 as they move at rapid rates of speed from the root end 18 to the tip end 20 of vane 25. It will be seen that the convergent paths of the particles focus at point "F" some distance beyond the end of tip end 20. This convergence causes the particles to cross at "F" and, at some point beyond the focus at distance h, the pattern becomes wider. In fact, the pattern can easily become wider than that projected from a standard straight sided vane. Actually, this vane works optimally only at a distance "J" equal to the distance from the tip end to the focus "F." Many times practical machine design considerations make it impractical to work at distance "J" and thus a new vane would have to be designed to obtain an optimum pattern for such work.

Figure 3:
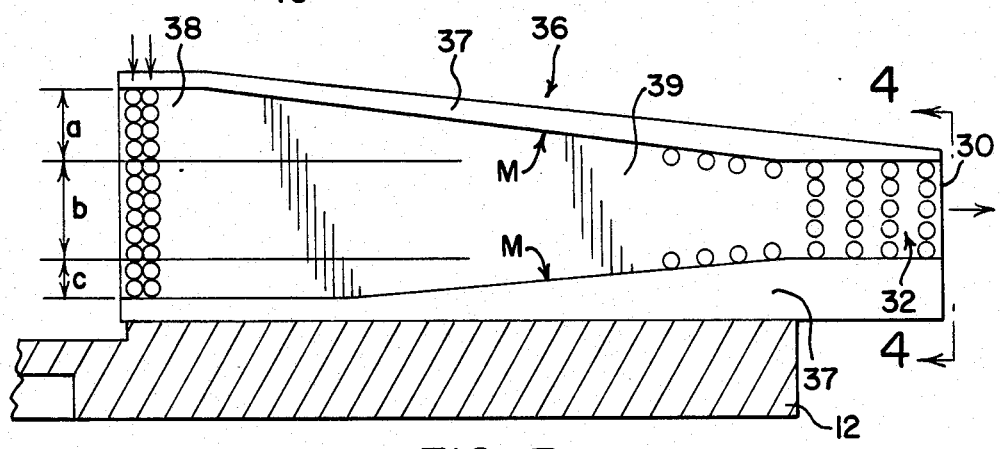
FIG. 3 (PRIOR ART)
FIG. 3 is a view similar to FIG. 2 of another prior art vane.
Figure 4:
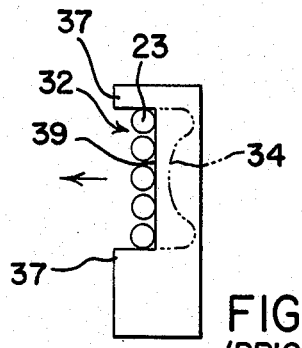
FIG. 4 (PRIOR ART)
FIG. 4 is a view taken along line 4—4 of FIG. 3.
Figure 5:
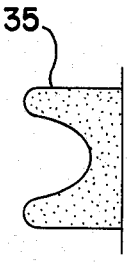
FIG. 5 (PRIOR ART)
FIG. 5 shows the particle pattern projected by the vane of FIGS. 3 upon excessive wear.

Consider now the narrow pattern vane configuration shown in FIG. 3, which is essentially the prior art vane disclosed in U.S. Pat. No. 3,287,858. Note that this vane 36 attempts to overcome the convergence problem just discussed by configuring the sides 37 to form a straight channel portion 32 at the discharge or tip end 30 of the vane. This configuration still has serious problems in that erosive wear on the vane is high and non-uniform and the resultant pattern is not uniform. As an illustration of this, the initial slug of abrasive that is deposited at the root end 38 of the vane 36 is divided for purposes of this explanation into areas "a," "b," and "c." In operation, all the particles in the areas of "a" and "c" converge along edges "M" due to the convergence of sides 37. Thus a concentration of particles is produced immediately adjacent the two edges of vane 36 at the tip end 30. The result of this uneven distribution of particles is shown in FIG. 4 where the bottom of the channel 39 in the straight portion 32 thereof is shown to be worn excessively at the outer edges thereof; see the erosion profile 34. Further, as shown in FIG. 5 the particles projected by such a vane assume an uneven pattern 35 not calculated to uniformly abrade any surface.

Referring now to the preferred embodiment of this invention as shown in FIGS. 1, 6, 7 and 8, it is seen that the vane 46 is not tapered, may have straight upright sides 47, and is provided with a relatively concave channel bottom 41 rather than a flat or straight channel bottom. A trough is thus formed having its low point at or near the center of the vane. In the case of the concave bottom, the pressure of the vane, as it rotates, forces the abrasive into the trough in such a manner that at the release point most of the abrasive will be concentrated in the center of the vane. The shape and depth of this trough can be adjusted to any required level of concentration, with the deepest though throwing the narrowest possible pattern. The concave channel bottom 41 may be "v-shaped" or have a flat bottom central surface. Since upright sides are not required to direct the flow of particles through the channel, they need not be provided in vanes made in accordance with this invention (see the dotted line 47' showing in FIG. 7).

Figure 6:
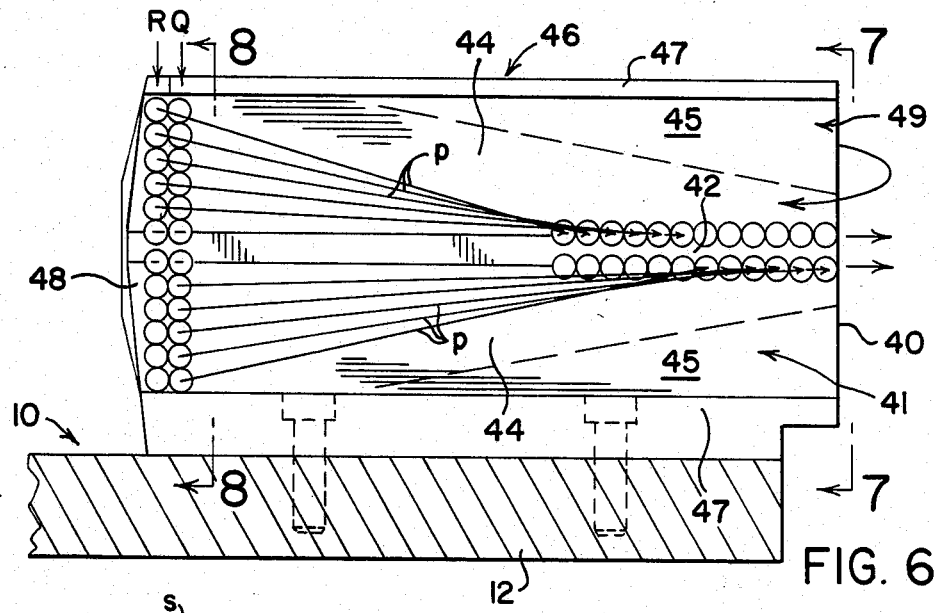
FIG. 6 is a view similar to FIG. 3, but taken along line 6—6 of FIG. 1, showing the preferred vane configuration of the invention.
Figure 7:
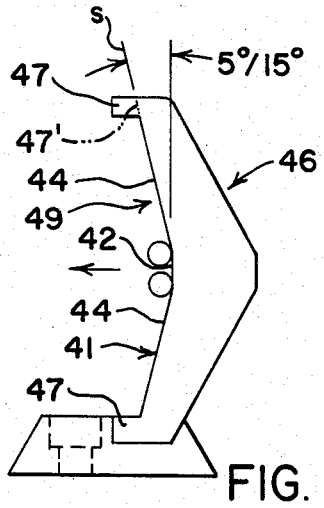
FIG. 7 is a view taken along line 7—7 of FIG. 6.

Further, as best seen in FIGS. 6 and 7, when, in operation, the particles accelerate from the root end 48 the particles at "Q" accelerate faster than those at "R" according to the formula $a=\omega^2 r$, so that as the first particles leave the tip of the vane the other particles are spread out over the length of the vane. In the formula, a is acceleration, $\omega$ is equal to $2\pi$ and r is the radius. It can now be seen that as the particles move outwardly on the vane the particles of the center portion reach the tip of the vane before those at the edges, due to the fact that the slope "s" of the channel bottom causes the particles to travel a path shown at "p". Since the particles near the edges of the vane must travel farther to reach the tip of the vane, they fall in behind the center particles and thus no crowding of particles on the vanes takes place. When these particles reach the flat bottom surface 42 of the vane adjacent the tip end 40 they travel in a straight line and a very narrow pattern results.

FIG. 7 shows vane 46 and its concave bottom channel 41 which has a flat bottom central surface 42 which runs the length of the vane 46. The canted surfaces 44 of the channel bottom which flank the flat bottom surface 42 are sloped at an angle of about 5° to about 15° rising upwardly to meet the edges of the channel 49 or the sides 47, is provided. It is these canted surfaces 44 which cam the particles at the edges toward the center of the vane.

Figure 8:
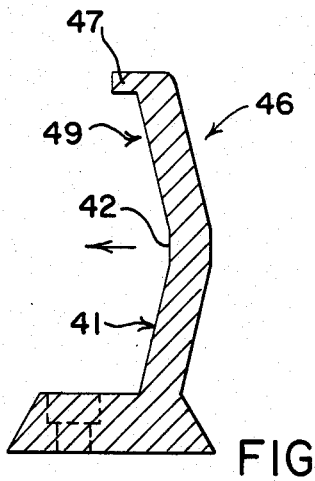
FIG. 8 is a view taken along line 8—8 of FIG. 6.

The very narrow pattern characterizing a blasting wheel having vanes of the type shown in FIGS. 6 to 8 is suitable for abrasive cleaning of wire or rod.

While the vanes may be of a uniform thickness; that is, the thickness of the structure on which the bottom surface is formed may be uniform throughout the length thereof, it has been found advantageous to provide a greater thickness at the tip end of the vane where the greatest wear is expected. The thickness of the vane may be uniformly increased from a relatively thin region adjacent to the root end of the vane to a substantially thicker section at the tip end of the vane. FIG. 7 shows the thicker cross-section at the tip of the vane while FIG. 8 shows a thinner cross-section at the root end of the vane.

The improved pattern obtained is illustrated in FIG. 12 in which the pattern characterizing the vane of this invention is contrasted wth the pattern projected by a conventional or standard vane.

Figure 9:
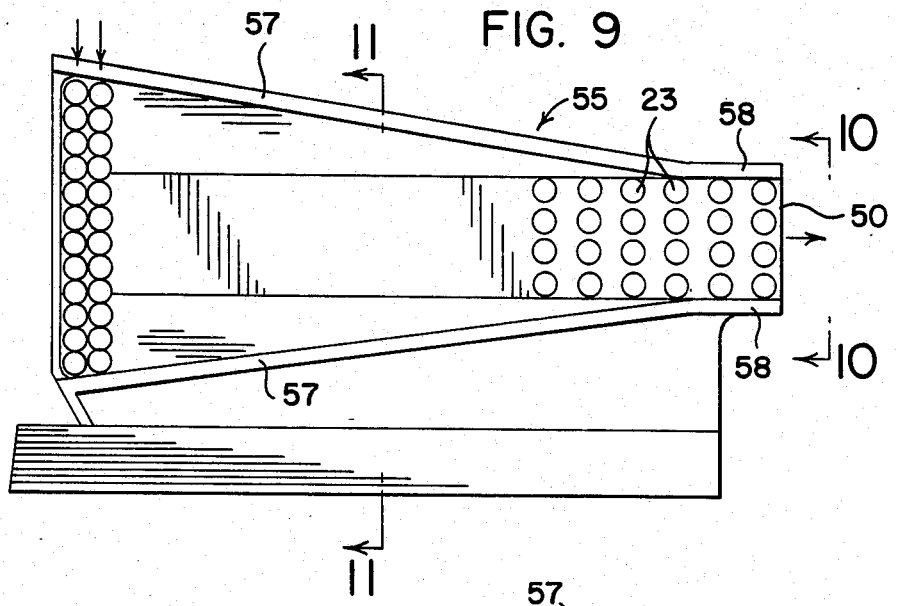
FIG. 9 is a view similar to FIG. 2 showing a modified vane configuration of the invention.
Figure 10:
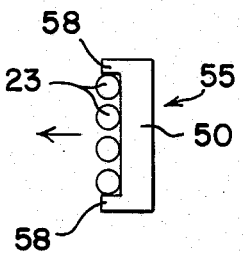
FIG. 10 is a view taken along line 10—10 of FIG. 9.
Figure 11:
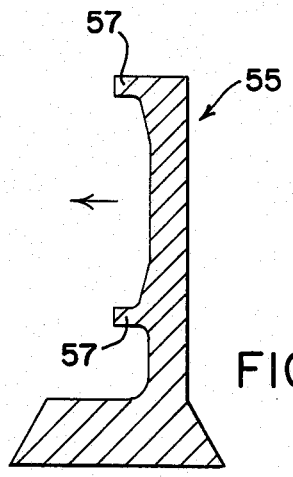
FIG. 11 is a view taken along line 11—11 of FIG. 9.

Since, in the embodiment shown in FIG. 6, very few particles contact the areas 45 of the channel 49, a further embodiment of this novel vane has been developed and is shown in FIG. 9. In this embodiment, the sides 57 of vane 55 are tapered to eliminate the areas identified as 45 in FIG. 5 without actually obstructing the path of the abrasive particles. Since the sides do not function to direct particles in the tapered region, they may be eliminated there in the manner shown in FIG. 7. However, since channel sides are necessary in the tip region, as described below, sides may be provided in the tapered region merely as a matter of manufacturing convenience. This embodiment of the vane of the invention will be slightly lighter than the vane of FIG. 5 and the straight sides 56 at the tip end 50 define a narrow channel to assure that the pattern width cannot exceed a predetermined dimension. FIG. 10 shows a cross-section of this embodiment at the tip end 50 of the vane and FIG. 11 shows a cross-section of this same blade midway between the root end and the tip.

While the invention has been described and illustrated with respect to straight vanes the same principles apply to the configuration of curved blasting wheel vanes and such a curved blade 65 is illustrated in FIG. 13.

Although the present invention has been described with the preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A vane for an abrasive blasting wheel comprising a relatively wide root region to receive abrasive particles, a tip region from which the abrasive particles are discharged and said vane having a face joining the root region to the tip region, said vane face having a channel bottom providing a path along which the abrasive particles move from the root region to the tip region, said channel bottom having a generally concave configuration whereby abrasive particles moving adjacent to the edges of said channel are cammed toward the center thereof, said generally concave configuration including a flat central bottom surface of generally uniform width extending entirely from said root region to said tip region.

2. A vane in accordance with claim 1 wherein the generally concave configuration of said channel bottom includes said flat central bottom surface being flanked by canted surfaces rising at an angle of at least 5 degrees.

3. A vane in accordance with claim 1 wherein the vane in alignment with said flat central bottom surface is relatively thin at the root region and substantially thicker at the tip region, the thickness of said vane decreasing towards side edges of said vane.

4. A vane in accordance with claim 3 wherein the thickness of the vane increases uniformly from the root region to the tip region.

5. A vane in accordance with claim 2 wherein said canted surfaces are tapered towards said tip region to provide a relatively narrower channel width at the tip region than at the root region.

6. A vane in accordance with claim 2 wherein said canted surfaces are tapered towards said tip region and terminate at said flat central bottom surface, and side walls are provided in the tip region only to define a channel there of uniform width equal to the width of said flat central bottom surface.

7. An abrasive blasting wheel assembly comprising a rotatable wheel, radially extending vanes on said wheel, said vanes each having a relatively wide root region to receive abrasive particles, a tip region from which the abrasive particles are discharged and said vane having a face joining the root region to the tip region, said vane faces each having a channel bottom providing a path along which the abrasive particles move from the root region to the tip region, said channel bottom having a generally concave configuration whereby abrasive particles moving adjacent to the edges of said channel are cammed toward the center thereof, said generally concave configuration including a flat central bottom surface of generally uniform width extending entirely from said root region to said tip region.

8. An abrasive blasting wheel assembly in accordance with claim 7 wherein the generally concave configuration of said channel bottom includes said flat central bottom surface being flanked by canted surfaces rising at an angle of at least 5 degrees.

9. An abrasive blasting wheel assembly in accordance with claim 7 wherein the vane in alignment with said flat central bottom surface is relatively thin at the root region and substantially thicker at the tip region, the thickness of said vane decreasing towards side edges of said vane.

10. An abrasive blasting wheel assembly in accordance with claim 9 wherein the thickness of the vane increases uniformly from the root region to the tip region.

11. An abrasive blasting wheel assembly in accordance with claim 8 wherein said canted surfaces are tapered towards said tip region to provide a relatively narrower channel width at the tip region than at the root region.

12. An abrasive blasting wheel assembly in accordance with claim 8 wherein said canted surfaces of each vane are tapered toward said tip region and terminate at said flat central bottom surface, and side walls are provided only in the tip region to define a channel there of uniform width equal to the width of said flat central bottom surface.

* * * * *